US010704786B2

(12) United States Patent
Laster et al.

(10) Patent No.: US 10,704,786 B2
(45) Date of Patent: Jul. 7, 2020

(54) FUEL INJECTOR INCLUDING A LOBED MIXER AND VANES FOR INJECTING ALTERNATE FUELS IN A GAS TURBINE

(71) Applicant: Siemens Energy, Inc., Orlando, FL (US)

(72) Inventors: Walter Ray Laster, Oviedo, FL (US); Timothy A. Fox, Hamilton (CA); Robert H. Bartley, Oviedo, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 226 days.

(21) Appl. No.: 15/540,405

(22) PCT Filed: Jan. 29, 2015

(86) PCT No.: PCT/US2015/013486
§ 371 (c)(1),
(2) Date: Jun. 28, 2017

(87) PCT Pub. No.: WO2016/122521
PCT Pub. Date: Aug. 4, 2016

(65) Prior Publication Data
US 2017/0363291 A1 Dec. 21, 2017

(51) Int. Cl.
*F23R 3/00* (2006.01)
*F23R 3/14* (2006.01)
(Continued)

(52) U.S. Cl.
CPC ..... *F23R 3/14* (2013.01); *F23D 14/24* (2013.01); *F23R 3/286* (2013.01); *F23R 3/36* (2013.01); *F23R 2900/00002* (2013.01)

(58) Field of Classification Search
CPC .... F23R 3/14; F23R 3/286; F23R 3/36; F23R 2900/00002; F23D 14/24; F23D 11/383; F23D 2900/14241; F23D 2900/14021
See application file for complete search history.

(56) References Cited

U.S. PATENT DOCUMENTS 4,045,957 A * 9/1977 DiSabato ..... F02K 1/386 60/262
5,251,447 A * 10/1993 Joshi ..... F23R 3/14 239/403
(Continued)

FOREIGN PATENT DOCUMENTS

CN 101031713 A 9/2007
CN 201006402 U 1/2008
(Continued)

OTHER PUBLICATIONS

Airfoils and Airflow, Jul. 31, 2013 (Year: 2013).*
(Continued)

*Primary Examiner* — Todd E Manahan
*Assistant Examiner* — Edwin Kang

(57) ABSTRACT

A fuel injector for injecting alternate fuels having a different energy density in a gas turbine is provided. A first fuel supply channel (18) may be fluidly coupled to a radial passage (22) in a plurality of vanes (20) that branches into passages (24) (e.g., axial passages) to inject a first fuel without jet in cross-flow injection. This may be effective to reduce flashback in fuels having a relatively high flame speed. A mixer (30) with lobes (32) for injection of a second fuel may be arranged at the downstream end of a fuel delivery tube (12). A fuel-routing structure (38) may be configured to route the second fuel within a respective lobe so that fuel injection of the second fuel takes place radially outwardly relative to a central region of the mixer. This may be conducive to an improved (e.g., a relatively more uniform) mixing of air and fuel.

14 Claims, 4 Drawing Sheets

(51) Int. Cl.

| | |
|---|---|
| ***F23R 3/36*** | (2006.01) |
| ***F23D 14/24*** | (2006.01) |
| ***F23R 3/28*** | (2006.01) |

(56) References Cited

U.S. PATENT DOCUMENTS

| | | | | |
|---|---|---|---|---|
| 6,786,038 | B2 * | 9/2004 | Lair | B64D 33/06 181/213 |
| 6,935,098 | B2 * | 8/2005 | Bardagi | F02K 1/48 181/213 |
| 8,511,087 | B2 | 8/2013 | Fox et al. | |
| 8,661,779 | B2 | 3/2014 | Laster et al. | |
| 2008/0083229 | A1 * | 4/2008 | Haynes | F02C 3/28 60/776 |
| 2013/0067920 | A1 * | 3/2013 | Fox | F23R 3/14 60/738 |
| 2016/0186662 | A1 * | 6/2016 | Stewart | F23R 3/14 239/403 |

FOREIGN PATENT DOCUMENTS

| | | | |
|---|---|---|---|
| CN | 103174547 | A | 6/2013 |
| CN | 104019465 | A | 9/2014 |
| EP | 2604919 | A1 | 6/2013 |

OTHER PUBLICATIONS

PCT International Search Report and Written Opinion dated Sep. 30, 2015 corresponding to PCT Application No. PCT/US2015/013486 filed Jan. 29, 2015.

* cited by examiner

FUEL INJECTOR INCLUDING A LOBED MIXER AND VANES FOR INJECTING ALTERNATE FUELS IN A GAS TURBINE

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

BACKGROUND

1. Field

Disclosed embodiments are generally related to fuel injectors for a gas turbine, and, more particularly, to fuel injectors including a lobed mixer and vanes for injecting alternate fuels in the turbine.

2. Description of the Related Art

Economic considerations have pushed the development of gas turbines capable of using alternate fuels, such as may involve synthetic gases (e.g., syngas) in addition to using fuels, such as natural gas and liquid fuels, e.g., oil. These synthetic gases typically result from gasification processes of solid feedstock such as coal, pet coke or biomass. These processes may result in fuels having substantially different fuel properties, such as composition, heating value and density, including relatively high hydrogen content and gas streams with a significant variation in Wobbe index (WI). The Wobbe index is generally used to compare the combustion energy output of fuels comprising different compositions. For example, if two fuels have identical Wobbe indices, under approximately identical operational conditions, such as pressure and valve settings, the energy output will be practically identical.

Use of fuels having different fuel properties can pose various challenges. For example, as the heating value of the fuel drops, a larger flow area would be required to deliver and inject the fuel into the turbine and provide the same heating value. Thus, it is known to construct different passages for the injector flow to accommodate the Wobbe index variation in the fuels. Another challenge is that fuels having a high hydrogen content can result in a relatively high flame speed compared to natural gas and the resulting high flame speed can lead to flashback in the combustor of the turbine engine. See U.S. Pat. Nos. 8,661,779 and 8,511,087 as examples of prior art fuel injectors involving vanes using a traditional jet in cross-flow for injection of alternate fuels in a gas turbine.

DETAILED DESCRIPTION

Figure 1:
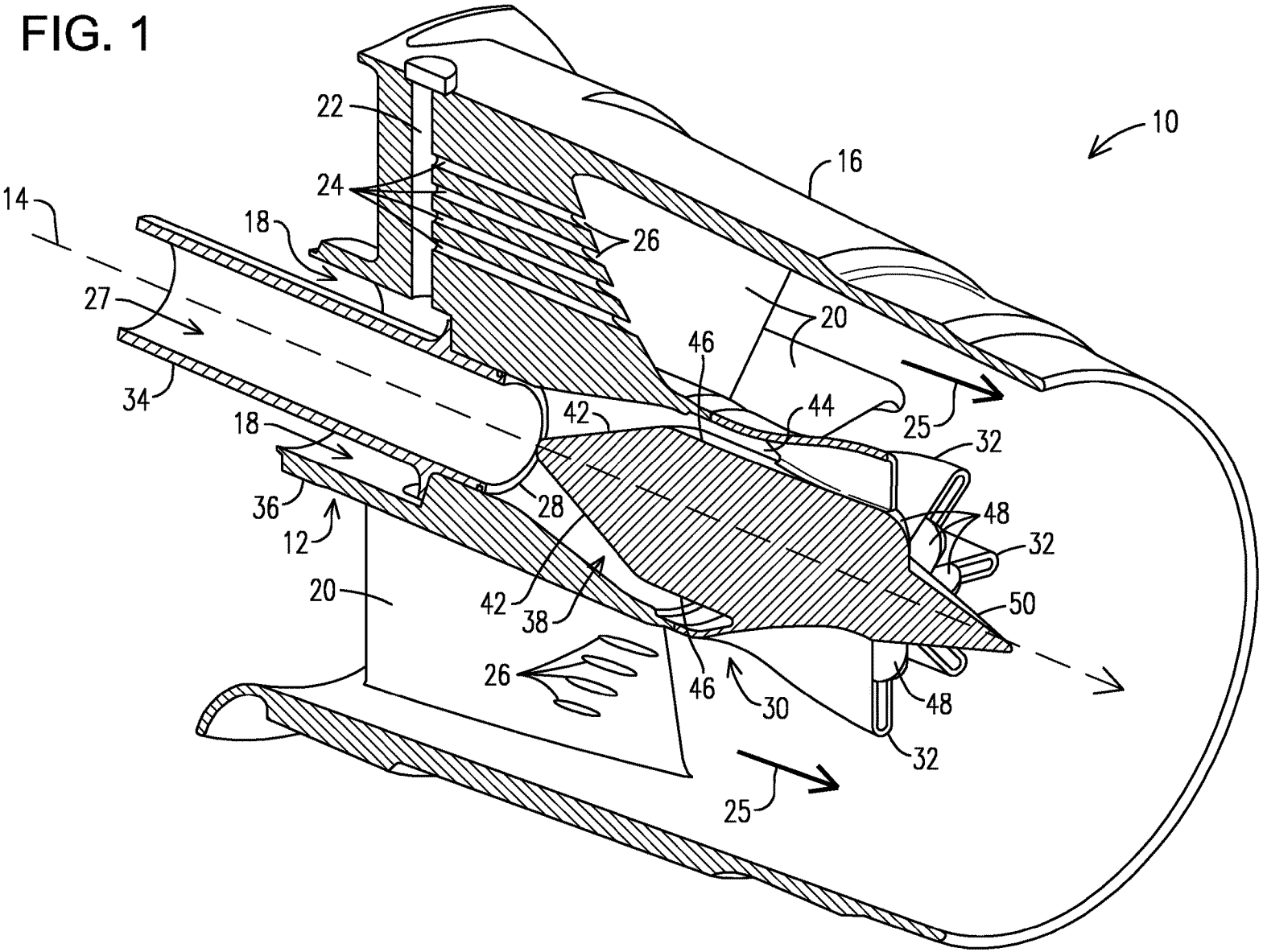
FIG. 1 is an isometric view of one non-limiting embodiment of a fuel injector embodying aspects of the invention, as may be used in a gas turbine capable of using alternate fuels.

The inventors of the present invention have recognized certain issues that can arise in the context of certain prior art fuel injectors that may involve a lobed mixer and vanes for injecting alternate fuels in a gas turbine. For example, some known fuel injector designs involve vanes using a jet in cross-flow injection to obtain a well-mixed fuel/air stream into the combustor of the turbine engine. However, such designs may exhibit a tendency to flashback, particularly in the context of fuels with high hydrogen content. In view of such recognition, the present inventors propose a novel fuel injector arrangement where fuel is injected without jet in cross-flow injection, such as in the direction of the air flow in lieu of the traditional jet in cross-flow injection. Additionally, the present inventors have further recognized that one known fuel injector design including a lobe mixer may result in certain mixing zones not conducive to a relatively uniform mixture of air and fuel, such as in zones where air flow may be somewhat diminished compared to other mixing zones. Accordingly, the present inventors further propose a fuel-routing structure conducive to an improved mixing of air and fuel.

In the following detailed description, various specific details are set forth in order to provide a thorough understanding of such embodiments. However, those skilled in the art will understand that embodiments of the present invention may be practiced without these specific details, that the present invention is not limited to the depicted embodiments, and that the present invention may be practiced in a variety of alternative embodiments. In other instances, methods, procedures, and components, which would be well-understood by one skilled in the art have not been described in detail to avoid unnecessary and burdensome explanation.

Furthermore, various operations may be described as multiple discrete steps performed in a manner that is helpful for understanding embodiments of the present invention. However, the order of description should not be construed as to imply that these operations need be performed in the order they are presented, nor that they are even order dependent, unless otherwise indicated. Moreover, repeated usage of the phrase "in one embodiment" does not necessarily refer to the same embodiment, although it may. It is noted that disclosed embodiments need not be construed as mutually exclusive embodiments, since aspects of such disclosed embodiments may be appropriately combined by one skilled in the art depending on the needs of a given application.

The terms "comprising", "including", "having", and the like, as used in the present application, are intended to be synonymous unless otherwise indicated. Lastly, as used herein, the phrases "configured to" or "arranged to" embrace the concept that the feature preceding the phrases "configured to" or "arranged to" is intentionally and specifically designed or made to act or function in a specific way and should not be construed to mean that the feature just has a capability or suitability to act or function in the specified way, unless so indicated.

FIG. 1 is an isometric view of one non-limiting embodiment of a fuel injector 10 embodying aspects of the invention, as may be used in a gas turbine capable of using alternate fuels. A fuel delivery tube structure 12 is disposed along a central axis 14 of fuel injector 10. Fuel delivery tube structure 12 may be surrounded by a shroud 16. A first fuel supply channel 18 may be arranged in fuel delivery tube structure 12.

Figure 2:
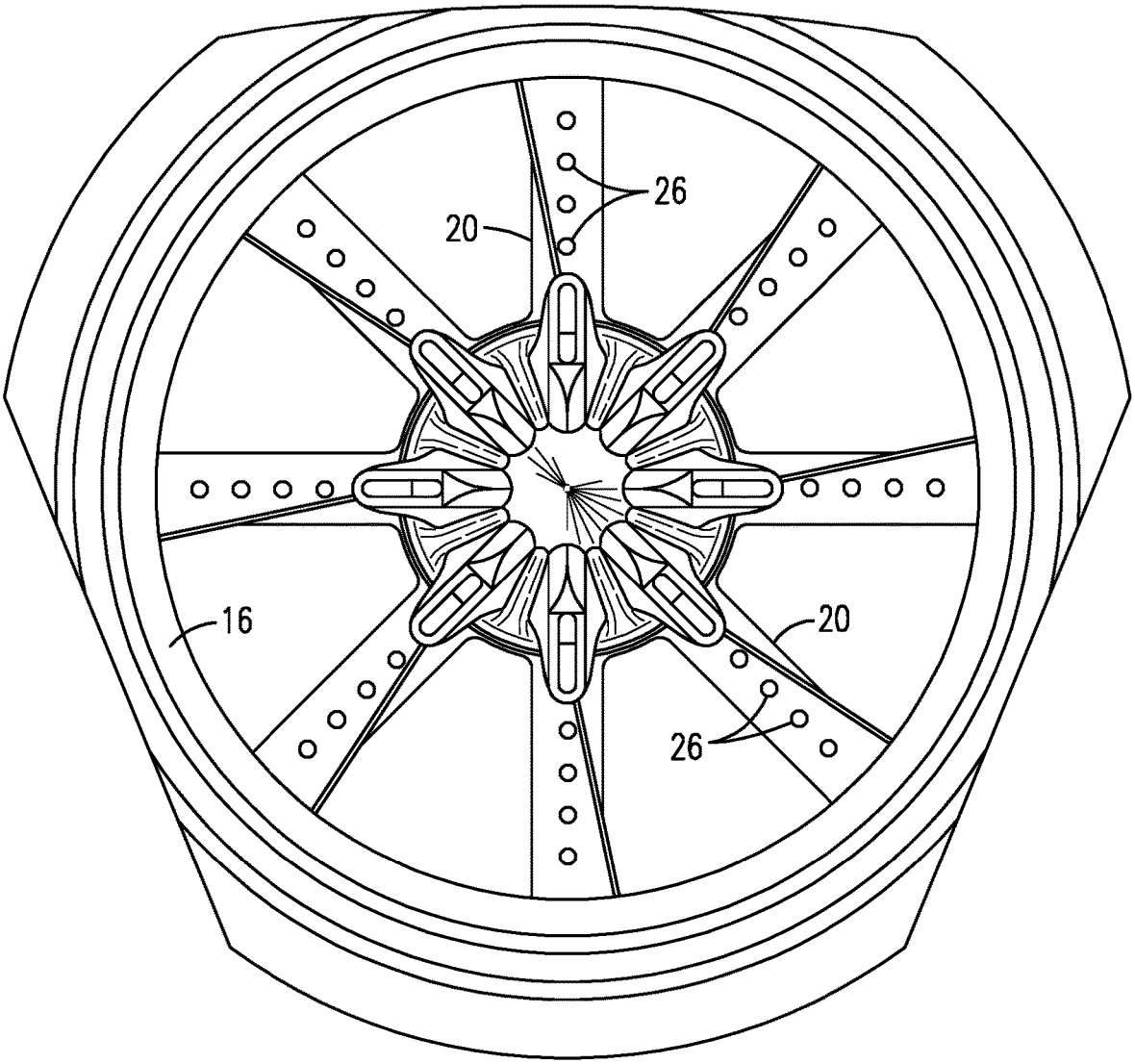
FIG. 2 is an elevational view of the downstream end of a fuel injector embodying aspects of the invention.

A plurality of vanes 20 may be circumferentially disposed about fuel delivery tube structure 12, such as arranged between fuel delivery tube structure 12 and shroud 16. A radial passage 22 may be constructed in each vane 20. Radial passage 22 is in fluid communication with first fuel supply channel 18 to receive a first fuel. In one non-limiting embodiment, radial passage 22 may be configured to branch into a set of passages 24 (e.g., axial passages) each having an aperture 26 arranged to inject the first fuel not in a jet in cross-flow mode, such as in a direction of air flow, schematically represented by arrows 25. This arrangement (without jet in cross-flow injection) is believed to substantially reduce the flashback tendencies generally encountered in the context of fuels with high hydrogen content. As may be appreciated in FIG. 2, the plurality of vanes 20 may include a respective twist angle, which in one non-limiting embodiment may comprise up to approximately 20 degrees at the tip of the vane.

A second fuel supply channel 27 is arranged in fuel delivery tube structure 12. Second fuel supply channel 27 may extend to a downstream end 28 of fuel delivery tube structure 12, where a mixer 30 with a plurality of lobes 32 (e.g., radially elongated folded edges) is disposed for fuel injection of a second fuel.

In one non-limiting embodiment, delivery tube structure 12 may comprise coaxially disposed inner 34 and outer tubes 36, wherein inner tube 34 comprises the second fuel supply channel 27, and where the first fuel supply channel 18 is annularly disposed between inner and outer tubes 34, 36. In one non-limiting embodiment the first fuel and the second fuel may comprise fuels having a different energy density. For example, without limitation, the first fuel that flows in first fuel supply channel 18 may comprise syngas, and the second fuel that flows in second fuel supply channel 27 may comprise natural gas.

Figure 3:
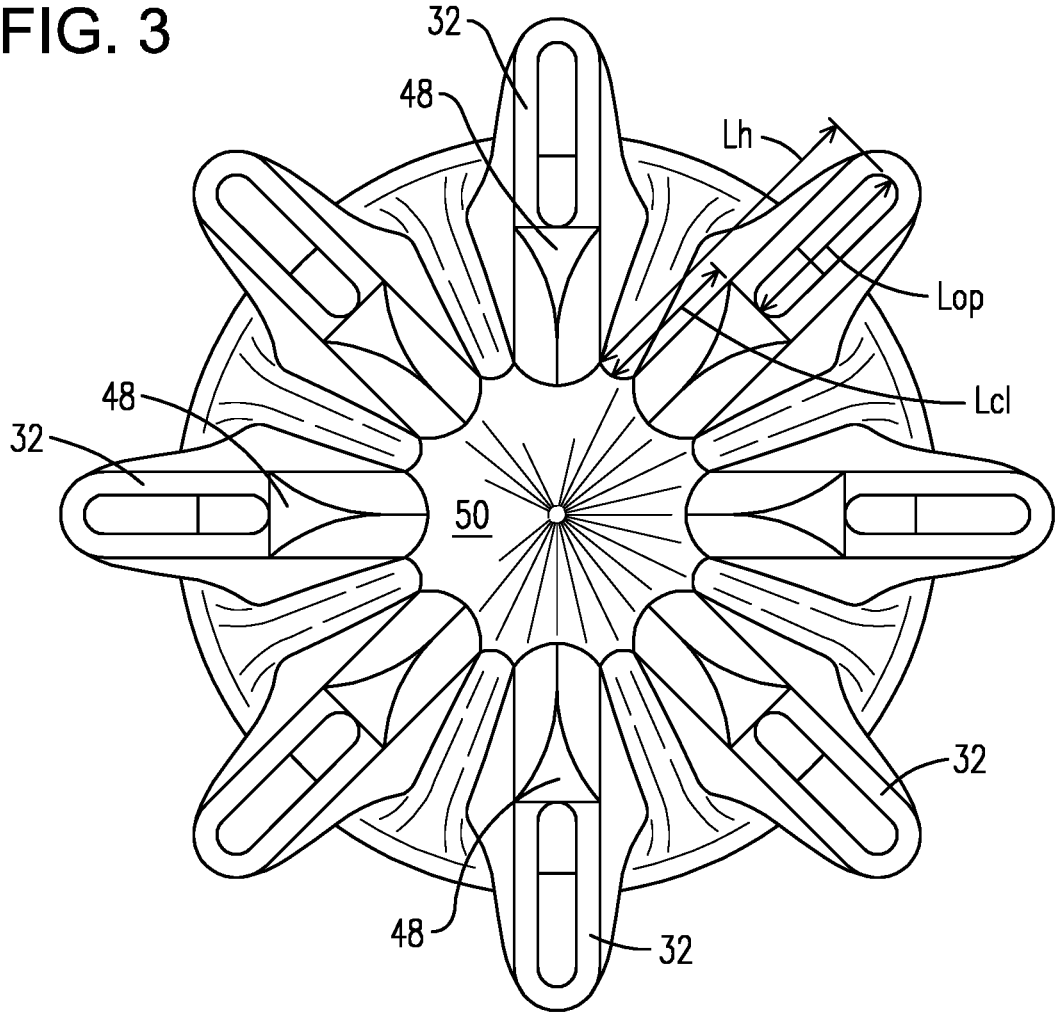
FIG. 3 is an elevational view of the downstream end of a lobed mixer embodying aspects of the invention.

In one non-limiting embodiment, mixer 30 comprises a means for routing the second fuel within a respective lobe, such as a fuel-routing structure 38 configured to route the second fuel within a respective lobe so that fuel injection of the second fuel takes place radially outwardly relative to a central region of the mixer, such as between a radially intermediate portion of the respective lobe and a radially outermost portion of the respective lobe. This is conceptually represented in FIG. 3 by a line labelled with the letters Lop (e.g., indicative of an open lobe segment where fuel flow takes place) that extends between the radially intermediate portion of the respective lobe and the radially outermost portion of the respective lobe.

In one non-limiting embodiment, depending on the needs of a given application, the radially intermediate portion of the respective lobe may be disposed in a range from approximately 25% of the respective lobe height to approximately 75% of the respective lobe height. As may be appreciated in FIG. 3, the line labelled with the letters Lh represents lobe height, and the line labelled with the letters Lcl is indicative of a segment of the lobe which is closed by fuel-routing structure 38 (effectively blocking fuel flow in this segment of the lobe) and which terminates at the radially intermediate portion of the respective lobe where the open lobe segment Lop starts. This arrangement is effective to inject the second fuel radially outwardly relative to the central region of the mixer. Routing the second fuel for injection radially away from the central region of the mixer is advantageous since air flow by the central region of the mixer tends to be somewhat reduced and thus injecting fuel flow for mixing with this reduced air flow could otherwise lead to uneven mixing of air and fuel, such as the formation of pockets comprising a relatively fuel-enriched mixture. Thus, the fuel-routing structure is conducive to an improved (e.g., a relatively more uniform) mixing of air and fuel.

Figure 4:
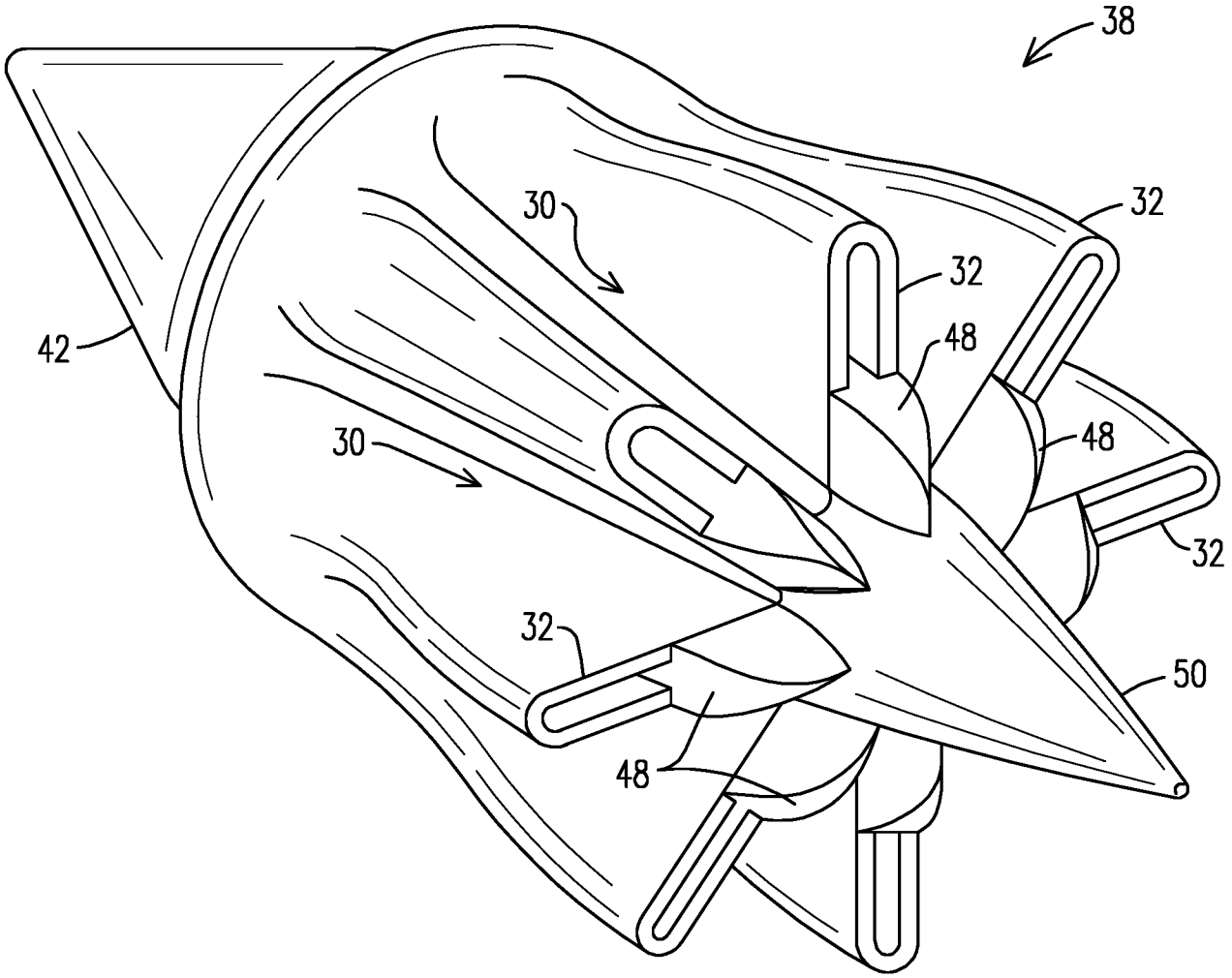
FIG. 4 is an isometric view of a lobed mixer embodying aspects of the invention.

In one non-limiting embodiment, as may be appreciated in FIGS. 1 and 4, fuel-routing structure 38 comprises a transition surface 42 (e.g., conical shape) configured to transition fuel flow from second fuel supply channel 27 towards a conduit 44 (FIG. 1) in the respective lobe. The fuel-routing structure may further comprise a routing surface 46 axially extending through the respective lobe. Routing surface is disposed at the radially intermediate portion of the respective lobe to in part define the conduit 44 in the respective lobe. In one non-limiting embodiment, fuel-routing structure 38 comprises a protrusion 48 that extends a predefined axial distance beyond the respective lobe and defines a curving profile towards a tip 50 of the fuel-routing structure. The curving profile may be shaped to provide an aerodynamic transition at the downstream end of the mixer.

Figure 5:
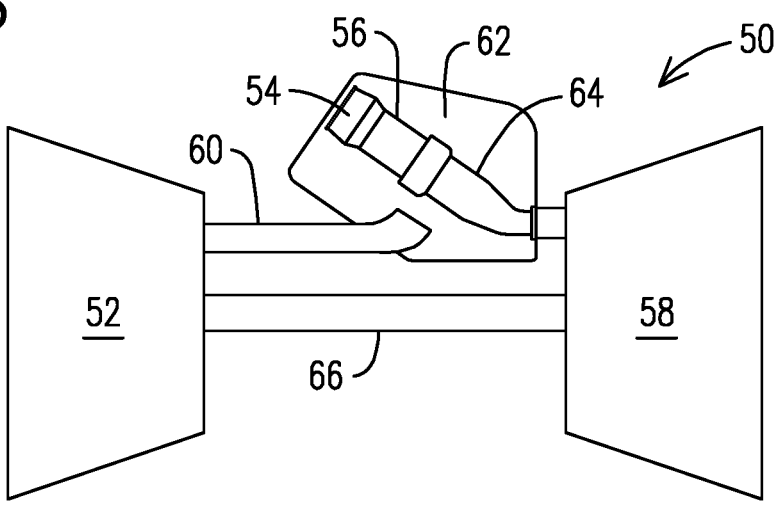
FIG. 5 is a simplified schematic of one non-limiting embodiment of a combustion turbine engine, such as gas turbine engine, that can benefit from disclosed embodiments of the present invention.

FIG. 5 is a simplified schematic of one non-limiting embodiment of a combustion turbine engine 50, such as gas turbine engine, that can benefit from disclosed embodiments of the present invention. Combustion turbine engine 50 may comprise a compressor 52, a combustor 54, a combustion chamber 56, and a turbine 58. During operation, compressor 52 takes in ambient air and provides compressed air to a diffuser 60, which passes the compressed air to a plenum 62 through which the compressed air passes to combustor 54, which mixes the compressed air with fuel, and provides combusted, hot working gas via a transition 64 to turbine 58, which can drive power-generating equipment (not shown) to generate electricity. A shaft 66 is shown connecting turbine 58 to drive compressor 52. Disclosed embodiments of a fuel injector embodying aspects of the present invention may be incorporated in each combustor (e.g., combustor 54) of the gas turbine engine to advantageously achieve reliable and cost-effective fuel injection of alternate fuels having a different energy density. In operation and without limitation, the disclosed fuel injector arrangement is expected to inhibit flashback tendencies that otherwise could develop in the context of fuels with high hydrogen content.

It will be appreciated that depending on the needs of a given application, one can optionally tailor aspects of the present invention based on the needs of the given application. For example, although aspects of the present invention are described in the context of a combination comprising vanes configured to inject a first fuel without jet in cross-flow injection, and a lobe mixer including a fuel-routing structure conducive to an improved mixing of air with a second fuel, broad aspects of the present invention need not be limited to such a combination. For example, in certain applications, one could optionally use the disclosed lobe mixer in combination with traditional vanes, such as may be configured to inject the first fuel with a jet in cross-flow injection. Alternatively, in certain other applications, one could optionally use the disclosed vanes, such as may be configured to inject the first fuel without jet in cross-flow injection with a traditional lobe mixer, such as may constructed without the disclosed fuel-routing structure. Thus, the disclosed embodiments need not be implemented in a combination, although they may be so implemented, since aspects of such disclosed embodiments may be individually tailored depending on the needs of a given application.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A fuel injector for a gas turbine, comprising:

a fuel delivery tube structure disposed along a central axis of the fuel injector, the fuel delivery tube structure surrounded by a shroud;

a first fuel supply channel arranged in the fuel delivery tube structure;

a plurality of vanes arranged between the fuel delivery tube structure and the shroud;

a radial passage in each vane of the plurality of vanes, the radial passage in fluid communication with the first fuel supply channel to receive a first fuel, wherein the radial passage is configured to branch into a set of axial passages each axial passage of the set of axial passages having an aperture arranged to inject the first fuel in a direction of air flow; and a second fuel supply channel arranged in the fuel delivery tube structure, the second fuel supply channel extending to a downstream end of the fuel delivery tube structure, wherein a mixer with a plurality of lobes for fuel injection of a second fuel is arranged at the downstream end, wherein the first fuel received in the first fuel supply channel comprises a lower density energy fuel relative to the second fuel received in the second fuel supply channel, wherein the mixer comprises a fuel-routing centerbody, wherein the fuel-routing centerbody comprises a transition surface configured to transition fuel flow from the second fuel supply channel towards a conduit in the respective lobe, wherein the fuel-routing centerbody comprises a routing surface axially extending through the respective lobe, the routing surface disposed at a radially intermediate portion of the respective lobe to partially define the conduit in the respective lobe, wherein the conduit between a radially innermost portion of the respective lobe and the radially intermediate portion of the respective lobe is fully closed by the fuel-routing centerbody to block the second fuel, and wherein the radially innermost portion of the respective lobe extends from the fuel-routing centerbody.

2. The fuel injector of claim 1, wherein the second fuel is routed within the respective lobe of the plurality of lobes so that the fuel injection of the second fuel takes place between the radially intermediate portion of the respective lobe and a radially outermost portion of the respective lobe.

3. The fuel injector of claim 2, wherein the radially intermediate portion of the respective lobe is disposed in a range from 25% of a respective lobe height to 75% of the respective lobe height.

4. The fuel injector of claim 1, wherein the fuel-routing centerbody comprises a protrusion that extends a predefined axial distance beyond the respective lobe and comprises a curving profile towards a tip of the fuel-routing centerbody.

5. The fuel injector of claim 1, wherein the plurality of vanes comprises a respective twist angle.

6. The fuel injector of claim 1, wherein each lobe of the plurality of lobes is disposed directly downstream relative to a vane of the plurality of vanes.

7. The fuel injector claim 1, wherein the delivery tube structure comprises coaxially disposed inner and outer tubes, wherein the inner tube comprises the second fuel supply channel, and wherein the first fuel supply channel is annularly disposed between the inner and the outer tubes.

8. The fuel injector of claim 1, wherein the first fuel comprises syngas and the second fuel comprise natural gas.

9. A fuel injector for a gas turbine, comprising:

a fuel delivery tube structure disposed along a central axis of the fuel injector, the fuel delivery tube structure; a first fuel supply channel arranged in the fuel delivery tube structure;

a plurality of vanes circumferentially disposed about the fuel delivery tube structure;

a radial passage in each vane of the plurality of vanes, the radial passage in fluid communication with the first fuel supply channel to receive a first fuel, wherein the radial passage is configured to branch into a set of axial passages each axial passage of the set of axial passages having an aperture arranged to inject the first fuel in a direction of air flow;

a second fuel supply channel arranged in the fuel delivery tube structure, the second fuel supply channel extending to a downstream end of the fuel delivery tube structure, wherein a mixer with a plurality of lobes for fuel injection of a second fuel is arranged at the downstream end; and wherein the second fuel is routed within a respective lobe so that the fuel injection of the second fuel takes place radially outwardly relative to a central region of the mixer, wherein the first fuel received in the first fuel supply channel comprises a lower density energy fuel relative to the second fuel received in the second fuel supply channel, wherein the mixer comprises a fuel-routing centerbody, wherein the fuel-routing centerbody comprises a transition surface configured to transition fuel flow from the second fuel supply channel towards a conduit in the respective lobe, wherein the fuel-routing centerbody comprises a routing surface axially extending through the respective lobe, the routing surface disposed at a radially intermediate portion of the respective lobe to partially define the conduit in the respective lobe, wherein the conduit between a radially innermost portion of the respective lobe and the radially intermediate portion of the respective lobe is fully closed by the fuel-routing centerbody to block the second fuel, and wherein the radially innermost portion of the respective lobe extends from the fuel-routing centerbody.

10. The fuel injector of claim 9, wherein the fuel injection of the second fuel takes place between the radially intermediate portion of the respective lobe and a radially outermost portion of the respective lobe.

11. The fuel injector of claim 10, wherein the radially intermediate portion of the respective lobe is disposed in a range from 25% of a respective lobe height to 75% of the respective lobe height.

12. The fuel injector of claim 9, wherein the plurality of vanes comprises a respective twist angle.

13. A fuel injector for a gas turbine, comprising:

a fuel delivery tube structure disposed along a central axis of the fuel injector, the fuel delivery tube structure surrounded by a shroud;

a first fuel supply channel arranged in the fuel delivery tube structure;

a plurality of vanes arranged between the fuel delivery tube structure and the shroud, respective vanes of the plurality of vanes including a passage in fluid communication with the first fuel supply channel to receive a first fuel; and a second fuel supply channel arranged in the fuel delivery tube structure, the second fuel supply channel extending to a downstream end of the fuel delivery tube structure, wherein a mixer with a plurality of lobes for fuel injection of a second fuel is arranged at the downstream end, wherein the second fuel is routed within a respective lobe so that the fuel injection of the second fuel takes place between a radially intermediate portion of the respective lobe and a radially outermost portion of the respective lobe, wherein the first fuel received in the first fuel supply channel comprises a lower density energy fuel relative to the second fuel received in the second fuel supply channel, wherein the passage in the respective vanes comprises a radial passage, wherein the radial passage is configured to branch into a set of axial passages each axial passage of the set of axial passages having an aperture arranged to inject the first fuel in a direction of air flow, wherein the mixer comprises a fuel-routing centerbody, wherein the fuel-routing centerbody comprises a transition surface configured to transition fuel flow from the second fuel supply channel towards a conduit in the respective lobe, wherein the fuel-routing centerbody comprises a routing surface axially extending through the respective lobe, the routing surface disposed at the radially intermediate portion of the respective lobe to partially define the conduit in the respective lobe, wherein the conduit between a radially innermost portion of the respective lobe and the radially intermediate portion of the respective lobe is fully closed by the fuel-routing centerbody to block the second fuel, and wherein the radially innermost portion of the respective lobe extends from the fuel-routing centerbody.

14. The fuel injector of claim 13, wherein the radially intermediate portion of the respective lobe is disposed in a range from 25% of a respective lobe height to 75% of the respective lobe height.

* * * * *